United States Patent [19]

Tachibana et al.

[11] Patent Number: 4,916,785

[45] Date of Patent: Apr. 17, 1990

[54] HEDDLE MAGAZINE

[75] Inventors: Juro Tachibana, Matsuyama; Yoshihide Nishimura, Iyo, both of Japan

[73] Assignee: Teijin Seiki Company Limited, Osaka, Japan

[21] Appl. No.: 215,391

[22] Filed: Jul. 5, 1988

[30] Foreign Application Priority Data

Jul. 10, 1987 [JP] Japan ..... 62-172349

[51] Int. Cl.[4] ..... D03J 1/14

[52] U.S. Cl. ..... 28/206; 28/205; 28/207

[58] Field of Search ..... 28/205, 206, 207

[56] References Cited

U.S. PATENT DOCUMENTS

| | | | |
|---|---|---|---|
| 1,171,389 | 2/1916 | Field | 28/207 |
| 2,127,616 | 8/1938 | Peterson | 28/205 |
| 2,230,494 | 2/1941 | Kieke | 28/205 X |
| 2,828,527 | 4/1958 | Mierhofer | 28/206 |
| 3,103,056 | 9/1963 | Wieneke | 28/207 |
| 3,744,109 | 7/1973 | Dohi et al. | 28/206 |
| 4,723,346 | 2/1988 | Tachibana et al. . | |

FOREIGN PATENT DOCUMENTS

| | | |
|---|---|---|
| 348937 | 10/1960 | Switzerland . |
| 593660 | 10/1947 | United Kingdom . |

*Primary Examiner*—Werner H. Schroeder
*Assistant Examiner*—Bradley K. DeSandro
*Attorney, Agent, or Firm*—Cushman, Darby & Cushman

[57] ABSTRACT

A heddle magazine comprising a pair of first magazine bars having carried thereon a plurality of heddles which form a first heddle group; a pair of second magazine bars disposed in parallel relationship to the first magazine bars and having carried thereon a plurality of heddles which form a second heddle group; a stationary magazine support having the first and second magazine bars stationarily mounted thereon; and means for removing the heddle one by one selectively from the first and second heddle groups and positioning the removed heddle into a predetermined position.

9 Claims, 11 Drawing Sheets

HEDDLE MAGAZINE

FIELD OF THE INVENTION

The present invention relates in general to warp-drawing apparatus, and in particular to an improvement in a heddle magazine which has a plurality of heddles carried thereon and which supplies the heddles to the warp-drawing apparatus.

DESCRIPTION OF THE PRIOR ART

A warp-drawing apparatus is generally provided with a heddle magazine which has a plurality of heddles carried thereon and which supplies the heddles one by one to the warp-drawing apparatus. The heddle magazine commonly employed for this purpose comprises a pair of upper and lower magazine bars having a plurality of heddles disposed in a row along the upper and lower magazine bars. Each heddle is formed at its central portion with an eccentric eye spaced a predetermined distance from the longitudinal axis of the heddle. It is necessary that the direction of the eccentric heddle eye be changed each time according to the weave of cloth in passing warp threads through the heddle eyes. Therefore, in the heddle magazine of the above type, the heddle removed one by one from the heddle magazine must be reversed about the longitudinal axis thereof by a complicated reversing mechanism. Because of the complicated mechanism, the conventional heddle magazine has the drawbacks that the production cost is increased, that it is difficult to adjust the mechanism and that a warp-drawing apparatus using the heddle magazine cannot be operated with high speed.

In order to overcome the drawbacks above described, there has been proposed a heddle magazine 1 provided with magazine bars disposed in two rows, as shown in FIGS. 19 and 20. The heddle magazine 1 comprises a pair of first magazine bars consisting of vertically spaced upper and lower magazine bars 2*a* and 2*b* and a pair of second magazine bars spaced parallel to the first magazine bars and consisting of vertically spaced upper and lower magazine bars 3*a* and 3*b*. The magazine bars 2*a*, 2*b*, 3*a*, and 3*b* are fixedly mounted at their proximal portions on an upright magazine support 4. A plurality of heddles 5 are carried through the upper and lower guide apertures thereof on the first magazine bars 2*a* and 2*b*, and form a first heddle group. Likewise, a plurality of heddles 5 are carried through the upper and lower guide apertures thereof on the second magazine bars 3*a* and 3*b*, and form a second heddle group. The first and second heddle group are supported such that the heddle eyes of the first heddle group and the heddle eyes of the second heddle group are opposite in the eccentric direction. A drive shaft 6 has the upright magazine support 4 fixedly mounted thereon and is rotatably supported on the stationary frame of a warp-drawing apparatus (not shown). Further, the drive shaft 6 is connected to a drive mechanism (not shown) so that the magazine bars 2*a*, 2*b*, 3*a* and 3*b* can rotate through the upright magazine support 4 on the drive shaft 6. When the drive shaft 6 is rotated in directions shown by the arrow in FIG. 19 to advance the heddles carried on the magazine bars and accordingly the foremost heddle 5 of the first or second heddle group is positioned in a receiving position A shown in FIG. 19, the heddle 5 is removed one by one from the first magazine bars 2*a* and 2*b* or the second magazine bars 3*a* and 3*b* by a heddle removing mechanism 7. The removed heddle is supplied to the warp-drawing apparatus. However, in this heddle magazine, it is necessary that the entire heddle magazine be rotated leftward and rightward to remove the heddle from the magazine bars. As the heddle magazine carries a plurality of heddles thereon and thus the inertia of force is large and further as the heddle magazine is rotated leftward and rightward at high speed, the conventional heddle magazine has the disadvantage in that the vibration and noise during the operation of apparatus are extremely large. Further, it was difficult to adjust the apparatus for the reasons above described. As a result, there is the drawback that the warp-drawing apparatus using the aforesaid heddle magazine cannot be operated with high speed.

Accordingly, it is an object of the present invention to provide an improved heddle magazine which is structurally simple, inexpensive and eliminates the vibration and noise during the operation and wherein the warp-drawing apparatus associated with the heddle magazine can be operated with high speed.

SUMMARY OF THE INVENTION

In accordance with one important aspect of the present invention, there is provided a heddle magazine comprising: a pair of first magazine bars having carried thereon a plurality of heddles which form a first heddle group; a pair of second magazine bars disposed in parallel relationship to the first magazine bars and having carried thereon a plurality of heddles which form a second heddle group; a stationary magazine support having the first and second magazine bars stationarily mounted thereon; and means for removing the heddle one by one selectively from the first and second heddle groups and positioning the removed heddle into a predetermined position.

In accordance with another important aspect of the present invention, there is provided a heddle magazine comprising: a pair of first upper and lower magazine bars having carried thereon a plurality of heddles which form a first heddle group; a pair of second upper and lower magazine bars disposed in parallel relationship to the first magazine bars and having carried thereon a plurality of heddles which form a second heddle group; a stationary magazine support having the first and second magazine bars stationarily mounted thereon; advancing means for advancing the first and second heddle groups; stop means for limiting the movements of the first and second heddle groups which are advanced by the advancing means; removing means for selectively removing one by one the heddle which is released by the stop means; and positioning means for positioning the removed heddle into a predetermined position.

The stationary magazine support may be fixedly mounted on a stationary frame member of a warp-drawing apparatus.

The advancing means may comprise a pair of first advancing means for advancing the first heddle group and second advancing means for advancing the second heddle group. The first advancing means may comprise an upper movable shaft and an upper press member mounted on the upper shaft and engageable with the upper end portion of the rearmost heddle of the first heddle group, and a lower movable shaft and a lower press member mounted on the lower shaft and engageable with the lower end portion of the rearmost of the first heddle group, and the second advancing means may comprise an upper movable shaft and an upper press member mounted on the upper shaft and engageable with the upper end portion of the rearmost heddle of the second heddle group, and a lower movable shaft and a lower press member mounted on the lower shaft and engageable with the lower end portion of the rearmost heddle of the second heddle group.

The stop means may comprise upper stop means for limiting the movements of the upper end portions of the foremost heddles of the first and second heddle groups, and lower stop means for limiting the movements of the lower end portions of the foremost heddles of the first and second heddle groups. The upper stop means may comprise a pair of a first stop member rotatable toward and away from the upper end portion of the foremost heddle of the first heddle group and having an engaging face engageable with the upper end portion of the foremost heddle of the first heddle group, and a second stop member rotatable toward and away from the upper end portion of the foremost heddle of the second heddle group and having an engaging face engageable with the upper end portion of the foremost heddle of the second heddle group. The lower stop means may comprise a pair of a first stop member rotatable toward and away from the lower end portion of the foremost heddle of the first heddle group and having an engaging face engageable with the lower end portion of the foremost heddle of the first heddle group, and a second stop member rotatable toward and away from the lower end portion of the foremost heddle of the second heddle group and having an engaging face engageable with the lower end portion of the foremost heddle of the second heddle group.

The removing means may be rotatable in directions substantially perpendicular to the moving direction of the heddle, and may comprise a drive shaft having mounted thereon radially extending first and second arms which are spaced from each other, a first rotatable guide member mounted on the first arm and having a first guide face, and a second rotatable guide member mounted on the second arm and having a second guide face disposed in parallel relationship to the first guide face, the heddle being guided and removed along the first and second guide faces when the removing means is rotated.

The positioning means may be rotatable in directions substantially perpendicular to the moving direction of the heddle, and comprises an upper positioning means for positioning the upper end portion of the removed heddle into the predetermined position, and a lower positioning means for positioning the lower end portion of the removed heddle into the predetermined position. The upper positioning means may have an outer guide face for guiding the upper end portion of the removed heddle to the predetermined position and an inner guide face for guiding the upper end portion of a new foremost heddle to the stop means, and the lower positioning means may have an outer guide face for guiding the lower end portion of the removed heddle to the predetermined position and an inner guide face for guiding the lower end portion of a new foremost heddle to the stop means.

BRIEF DESCRIPTION OF THE DRAWINGS

The drawbacks of a prior-art heddle magazine and the features and advantages of a heddle magazine according to the present invention will be more clearly understood from the following description taken in conjunction with the accompanying drawings.

DESCRIPTION OF THE PREFERRED EMBODIMENTS

Figure 1:
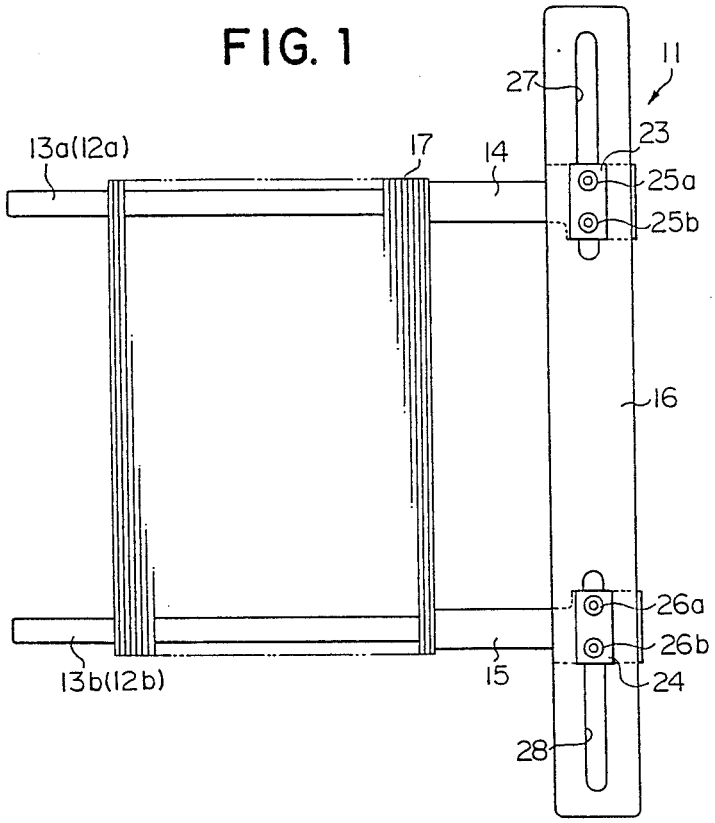
FIG. 1 is a side elevational view showing the magazine bars of a heddle magazine according to the present invention.
Figure 2:
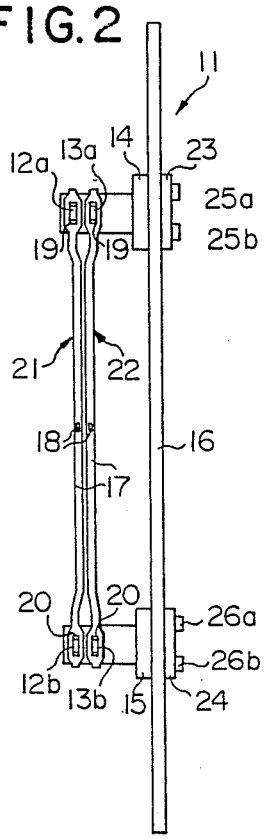
FIG. 2 is a front view of the magazine bars shown in FIG. 1.
Figure 3:
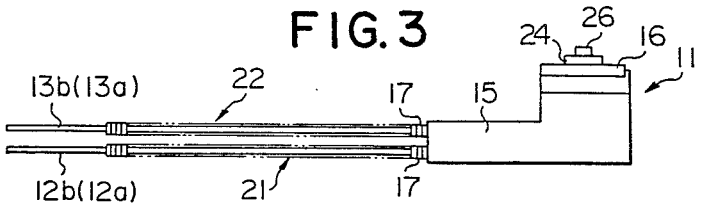
FIG. 3 is a bottom plan view of the magazine bars shown in FIG. 1.

Referring now in greater detail to the drawings and initially to FIGS. 1, 2 and 3, there is shown a heddle magazine generally designated by reference numeral 11. The heddle magazine 11 comprises a pair of first magazine bars consisting of vertically spaced upper and lower magazine bars 12*a* and 12*b*, and a pair of second magazine bars disposed in parallel relationship to the first magazine bars and consisting of vertically spaced upper and lower magazine bars 13*a* and 13*b*. The heddle magazine 11 further comprises an upper supporting bracket 14 to which the upper magazine bar 12*a* of the first magazine bars and the upper magazine bar 13*a* of the second magazine bars are fixed, a lower supporting bracket 15 to which the lower magazine bar 12*b* of the first magazine bars and the lower magazine bar 13*b* of the second magazine bars are fixed, and a stationary magazine support 16 having the upper and lower supporting brackets 14 and 15 supported thereto.

As shown in FIG. 2, a heddle 17 is in the form of a vertically extending thin plate and formed at its central portion with a heddle eye 18 and at its upper and lower ends with guide apertures 19 and 20. A mass of the heddles 17 are carried through the guide apertures 19 and 20 thereof on the first magazine bars 12*a* and 12*b*, and form a first heddle group 21. Likewise, a mass of the heddles 17 are carried through the guide apertures 19 and 20 thereof on the second magazine bars 13*a* and 13*b*, and form a second heddle group 22. The aforesaid upper and lower supporting brackets 14 and 15 are respectively fixed through washers 23 and 24 to the stationary magazine support 16 by means of bolts 25*a*, 25*b* and 26*a*, 26*b*. As shown in FIG. 1, the stationary magazine support 16 is formed at its upper end portion with a vertically elongated bore 27 through which the bolts 25*a* and 25*b* pass and at its lower end portion with a vertically elongated bore 28 through which the bolts 26*a* and 26*b* pass, so that the vertical spacing between the upper and lower brackets 14 and 15 can be adjusted according to the distance between the upper and lower guide apertures 19 and 20 of the heddle 17. The eye 18 of each heddle 17 is eccentrically disposed at a position horizontally spaced a predetermined distance from the longitudinal axis of the heddle 17. The heddles 17 and 17 of the first and second heddle groups 21 and 22 are supported such that the heddle eyes 18 of the first heddle group 21 and the heddle eyes 18 of the second heddle group 22 are disposed closely adjacent to each other.

Figure 4:
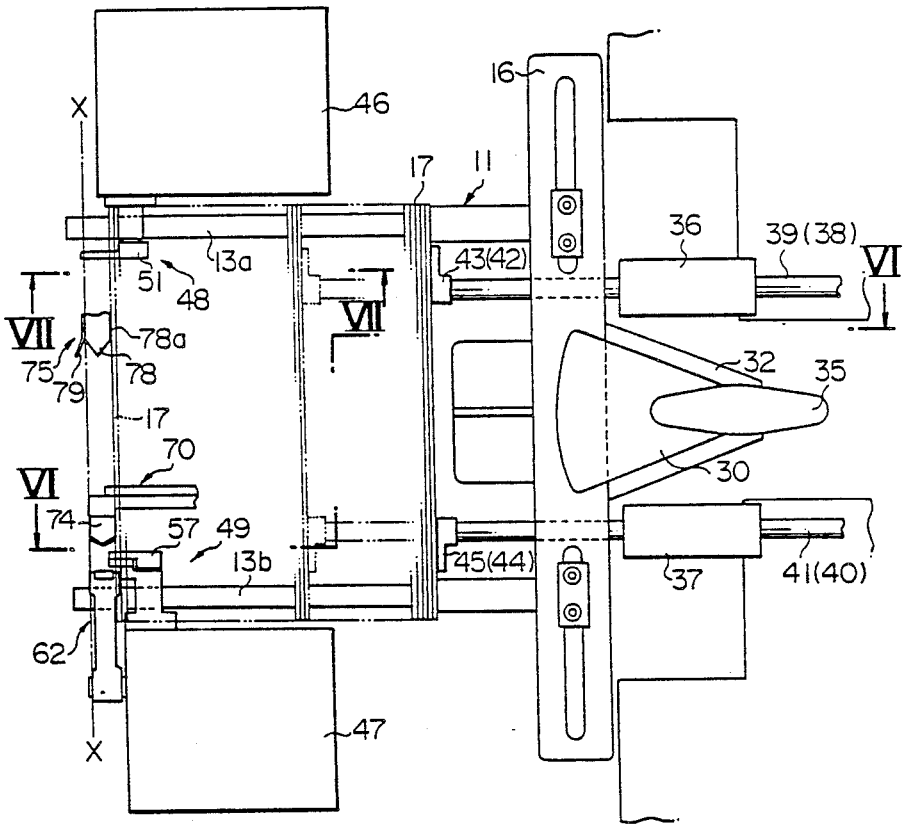
FIG. 4 is a longitudinal elevational view showing the heddle magazine according to the present invention.

Referring to FIGS. 4 through 7, the heddle magazine 11 is stationarily mounted on a stationary frame member 29 (FIG. 5) of a warp-drawing apparatus (not shown). The stationary magazine support 16 is held and fixed by a fan-type lever 30 and a bracket 32 which is mounted on a horizontal support 31 (FIG. 6) fixed to the stationary frame member 29. The fan-type lever 30 is carried by a horizontal threaded pin 34 which is freely rotatably supported on the bracket 32 and which is also freely rotatably supported on a bracket 33 fixed to the horizontal support 31 in parallel relationship to the bracket 32. A handle 35 is provided on the threaded pin 34 so that the stationary magazine support 16 can be firmly held between the lever 30 and the bracket 32 by the rotation of the handle 35. Thus, the heddle magazine 11 is stationarily mounted on the stationary frame member 29, when the magazine 11 is fixed by the lever 30. As shown in FIG. 4, there is provided a pair of vertically spaced upper and lower stuffing boxes 36 and 37. The upper stuffing box 36 has a pair of parallel drive shafts 38 and 39 horizontally slidably supported therein. Likewise, the lower stuffing box 37 has a pair of parallel drive shafts 40 and 41 horizontally slidably supported therein. The drive shafts 38, 39, 40 and 41 are respectively connected at their rear ends through respective link mechanisms (not shown) to respective actuators (not shown) and are respectively moved back and forth in the horizontal direction by the respective actuators. The drive shafts 38, 39, 40 and 41 have at their fore ends press members 42, 43, 44 and 45, respectively. When the drive shafts 38, 39, 40 and 40 are respectively advanced in the left direction in FIG. 4 by the actuators, the press members 42 and 44 are brought into engagement with the first heddle group 21 supported by the heddle magazine 11 and cause the first heddle group 21 to advance in the left direction. Similarly, the press members 44 and 45 are brought into engagement with the second heddle group 22 supported by the heddle magazine 11 and cause the second heddle group 22 to advance in the left direction.

Figure 8:
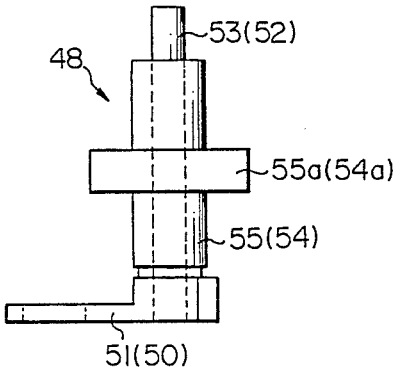
FIG. 8 is an enlarged side view showing the upper stop means shown in FIG. 7.
Figure 9:
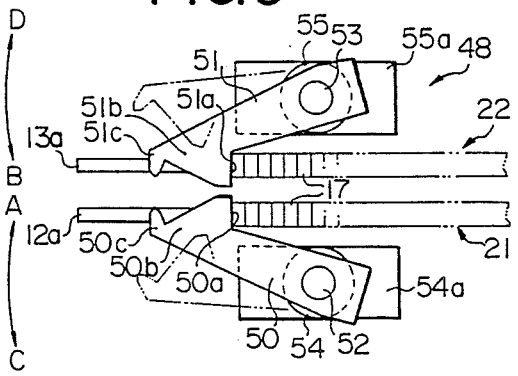
FIG. 9 is an enlarged top plan view showing the upper stop means rotated in its closed position wherein the movement of the upper end portions of the foremost heddles disposed in two rows are limited.
Figure 10:
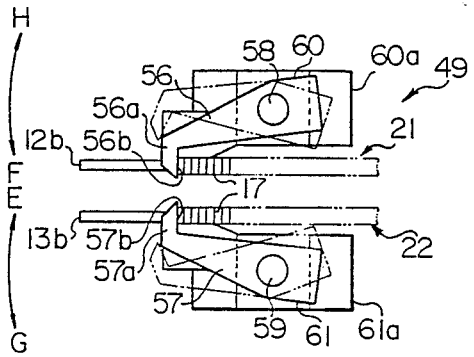
FIG. 10 is an enlarged top plan view of the lower stop means shown in FIG. 6, the means being rotated in its closed position wherein the movements of the lower end portions of the foremost heddles disposed in two rows are limited.
Figure 11:
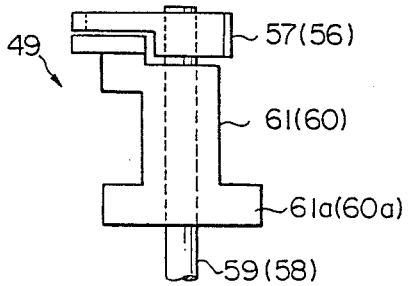
FIG. 11 is a side view of the lower stop means shown in FIG. 10.

A pair of vertically spaced upper and lower casings 46 and 47 each extend to the side of the heddle magazine 11 from the stationary frame member 29. The upper casing 46 is provided with upper stop means 48, and the lower casing 47 is provided with lower stop means 49 arranged in facing relationship to the upper stop means 48. The leftward movements of the first and second heddle groups 21 and 22 are limited by the upper and lower stop means 48 and 49, respectively. The upper stop means 48, as shown in FIGS. 8 and 9, comprises a pair of spaced upper stop fingers 50 and 51 fixedly mounted on the lower ends of pins 52 and 53, a pair of blocks 54 and 55 disposed on the opposite sides of the first and second heddle groups 21 and 22 and having the pins 52 and 53 rotatably supported therein. The blocks 54 and 55 are respectively formed at their intermediate portions with flange portions 54*a* and 55*a* through which the blocks 54 and 55 are mounted on the upper casing 46. The pins 52 and 53 are connected at their upper ends to suitable drive means (not shown) so that the upper stop fingers 50 and 51 can be rotated on the pins 52 and 53, respectively, by the drive means. The upper stop fingers 50 and 51 are respectively formed with first hook portions 50*b* and 51*b* having engaging faces 50*a* and 51*a*. When the stop fingers 50 and 51 are rotated in the directions A and B into the closed positions shown in full lines in FIG. 9, the engaging faces 50*a* and 51*a* are brought into engagement with the foremost heddles 17 and 17 of the first and second heddle groups 21 and 22, and limit the leftward movements of the heddles 17 and 17. The upper stop fingers 50 and 51 are further formed at their fore ends with second hook portions 50*c* and 51*c*, respectively. If one of the upper stop fingers 50 and 51 is rotated in the direction C or D into one of the open positions shown in broken lines in FIG. 9, the corresponding engaging face 50*a* or 51*a* is disengaged from the upper end portion of the foremost heddle 17 of the first or second heddle group 21 or 22 to permit the heddle 17 to be advanced leftward. The engaging faces 50*a* and 51*a* are disposed such that they are on the same vertical plane, when the upper stop fingers 50 and 51 are rotated toward each other into the closed positions. On the other hand, the lower stop means 49, as shown in FIGS. 10 and 11, comprises a pair of spaced lower stop fingers 56 and 57 fixedly mounted on the upper ends of pins 58 and 59, a pair of blocks 60 and 61 disposed on the opposite sides of the first and second heddle groups 21 and 22 and having the pins 58 and 59 rotatably supported therein. The blocks 60 and 61 are respectively formed at their lower portions with flange portions 60*a* and 61*a* through which the blocks 60 and 61 are mounted on the lower casing 47. The pins 58 and 59 are connected at their lower ends to suitable drive means (not shown) so that the lower stop fingers 56 and 57 can be rotated on the pins 58 and 59, respectively, by the drive means. The lower stop fingers 56 and 57 are respectively formed with hook portions 56*a* and 57*a* having engaging faces 56*b* and 57*b*. When the stop fingers 56 and 57 are rotated in the directions E and F into the closed positions shown in full lines in FIG. 10, the engaging faces 56*b* and 57*b* are brought into engagement with the foremost heddles 17 and 17 of the first and second heddle groups 21 and 22, and limit the leftward movements of the heddles 17 and 17. If one of the lower stop fingers 56 and 57 is rotated in the direction G or H into one of the open positions shown in broken lines in FIG. 10, the corresponding engaging face 56*b* or 57*b* is disengaged from the lower end portion of the foremost heddle 17 of the first or second heddle group 21 or 22 to permit the heddle 17 to be advanced leftward. The engaging faces 56*b* and 57*b* are disposed such that they are on the same vertical plane, when the upper stop fingers 50 and 51 are rotated toward each other in the closed positions.

Figure 12:
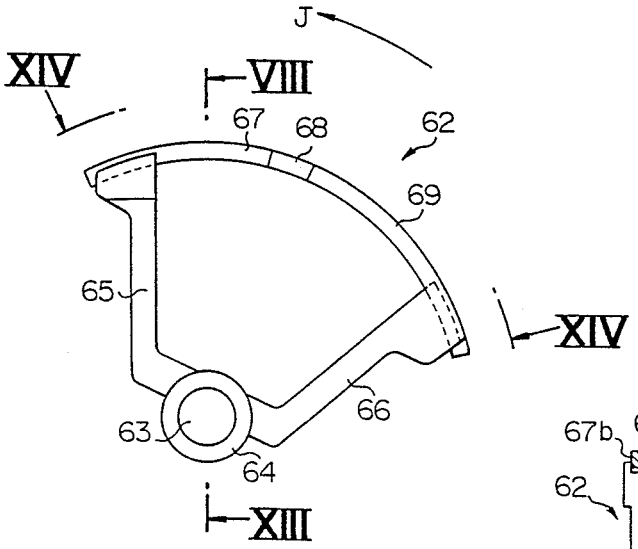
FIG. 12 is a fragmentary enlarged front view of a heddle removing and positioning means constructed in accordance with the present invention.
Figure 13:
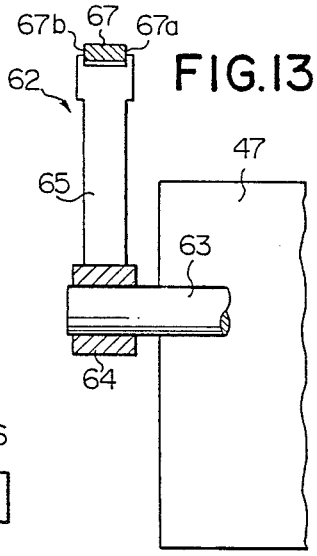
FIG. 13 is a fragmentary side view of the heddle removing and positioning means shown in FIG. 12.
Figure 14:
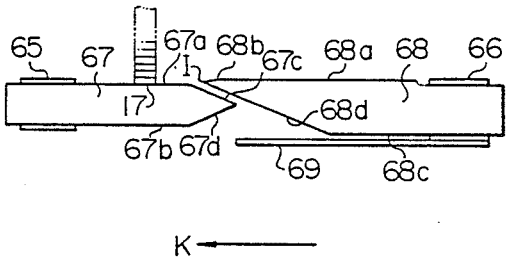
FIG. 14 is a top plan view of the heddle removing and positioning means taken substantially the line XIV—XIV in FIG. 12.

Returning back to FIGS. 4 to 6, there is provided a heddle removing means 62 which is adapted to remove the lower end of the foremost heddle 17 from the aforesaid lower stop means 49. The heddle removing means 62, as shown in FIGS. 12 to 14, comprises a drive shaft 63 rotatably supported on the lower casing 47 and protruding from the casing 47, a boss member 64 fixedly mounted on the left end of the drive shaft 63, a pair of spaced arms 65 and 66 each extending radially from the boss member 64, a first guide member 67 supported on the arm 65 and accurately formed with respect to the axis of the boss member 64, a second guide member 68 supported on the arm 66 and arcurately formed with respect to the axis of the boss member 64, and a third guide member 69 supported on the arm 66 and extending parallel to the second guide member 68. As shown in FIG. 14, the first arcuate guide member 67 has an inner side face 67*a* with which the heddle 17 engages, an inner inclined face 67*c* extending from the inner side face 67*a*, an outer side face 67*b* at the opposite side of the inner side face 67*a*, and an outer inclined face 67*d* extending from the outer side face 67*b* and terminating in the inner inclined face 67*c*. The second arcuate guide member 68 has at the side of the lowcr casing 47 an inner side face 68*a* which is slightly closer to the lower casing 47 than the inner side face 67*a* of the first guide member 67, an outer side face 68*c* at the opposite side of the inner side face 68*a*, an inclined face 68*d* extending from the outer side face 68*c* in parallel relationship to the inner inclined face 67*c* of the first guide member 67, and an inclined face 68*b* between the inner side face 68*a* and the inclined face 68*d*. The third guide member 69 extends in parallel relationship to the outer side face 68*c* of the second guide member 68 and terminated at a position which is located slightly beyond the intersection of the inclined faces 67*c* and 67*d* of the first guide member 67. On the other hand, the aforesaid drive shaft 63 is connected within the lower casing 47 to suitable drive means (not shown) so that the first, second and third guide members 67, 68 and 69 as a whole can be rotated about the drive shaft 63 in a direction J shown in FIG. 12 through the boss member 64 and the arms 65, 66. When the guide members 67, 68 and 69 are rotated in the direction J, they move together in a direction K shown in FIG. 14. When this occurring, the pointed end I of the second guide member 68 is inserted between the lower end portions of the foremost heddle 17 and the next heddle 17, and the lower end portion of the foremost heddle 17 is guided through the space between the inclined faces 67*c* and 68*d* to the inclined face 68*d*, and is moved toward the third guide member 69. It should be noted that the space between the inclined guide face 67*c* of the first guide member 67 and the inclined guide face 68*d* of the second guide member 68, and the space between the outer guide face 68*c* of the second guide member 68 and the third guide member 69 are each set to predetermined values which allow the lower end portion of the heddle 17 to be guided smoothly and to be supported suitably.

Figure 5:
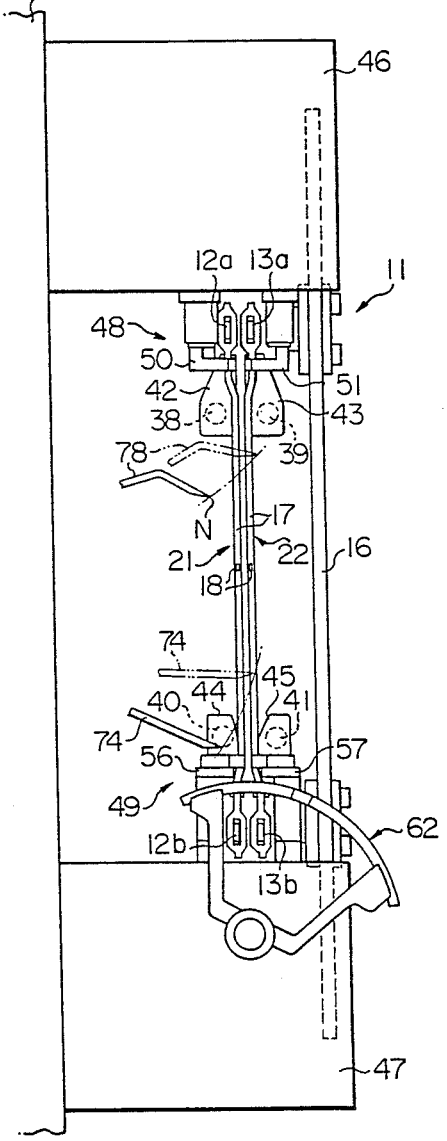
FIG. 5 is a front view showing the heddle magazine shown in FIG. 4.
Figure 6:
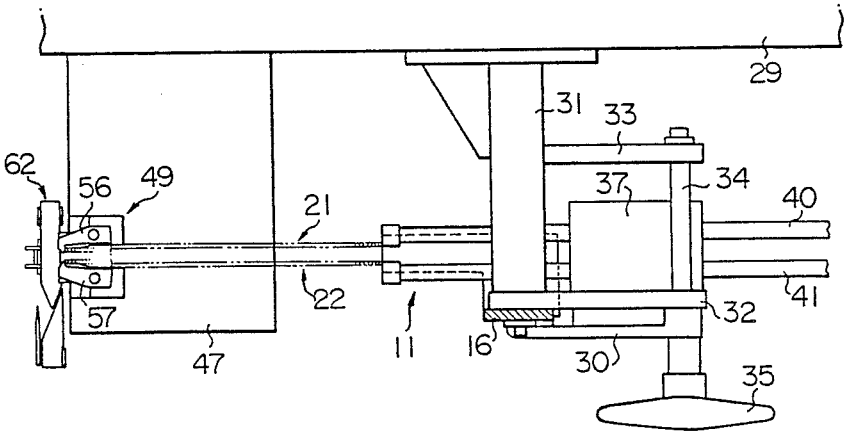
FIG. 6 is a fragmentary top plan view taken substantially along the line VI—VI of FIG. 4.
Figure 7:
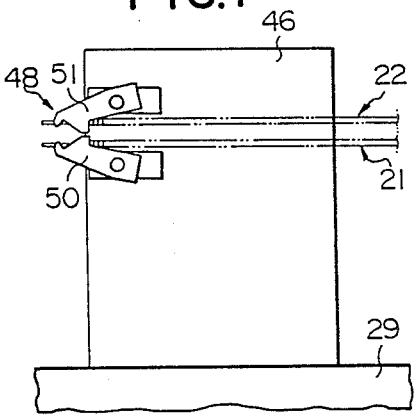
FIG. 7 is a fragmentary bottom plan view taken substantially along the line VII—VII of FIG. 4.
Figure 15:
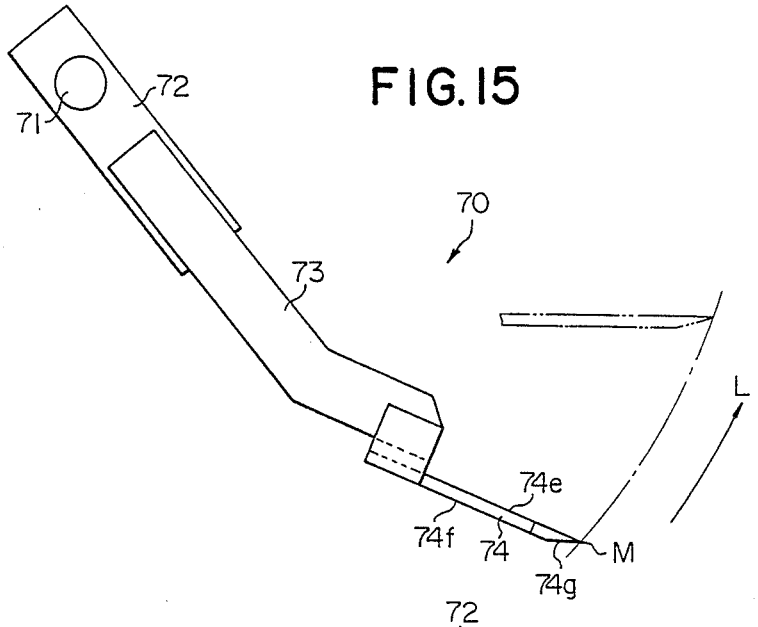
FIG. 15 is a front view showing a lower heddle fixing means constructed in accordance with the present invention.
Figure 16:
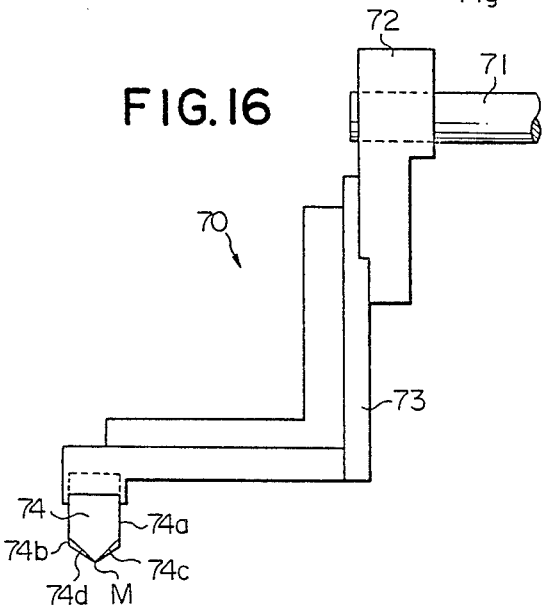
FIG. 16 is a side view of the lower heddle fixing means shown in FIG. 15.

In FIGS. 4 and 5, there are provided upper and lower heddle positioning means 75 and 70. The lower positioning means 70, as shown in FIGS. 15 and 16, comprises a drive shaft 71 freely rotatably supported at its right end portion in FIG. 16 to the stationary frame member 29, a first arm 72 fixedly mounted on the left end portion of the drive shaft 71, a generally L-shaped second arm 73 fixedly mounted at its proximal portion on the first arm 72, and a heddle positioning member 74 supported on the second arm 73. The drive shaft 71 is connected at its right end to suitable drive means to drive the heddle positioning member 74 to rotate on the drive shaft 71 in a direction L shown in FIG. 15. The heddle positioning member 74 has at the side of the first arm 72 an inner side face 74*a*, an inner inclined face 74*c* extending from the inner side face 74*a*, an outer side face 74*b* at the opposite side of the inner side face 74*a*, and an outer inclined face 74*d* extending from the outer side face 74*b* and terminating in the outer inclined face 74*c*. The heddle positioning member 74 further has an upper face 74*e*, a lower face 74*f* and a lower inclined face 74*g* extending from the lower face 74*f* and terminating in an intersection M of the inner and outer inclined faces 74*c* and 74*d*. The heddle positioning member 74 is disposed such that the inner face 74*a* thereof is on the vertical plane on which the engaging faces 56*b* and 57*b* of the stop fingers 56 and 57 of the lower stop means 49 are located when the stop fingers 56 and 57 are rotated toward each other in the closed positions. As previously indicated, when one of the lower stop fingers 56 and 57 is rotated to release the lower end portion of the heddle 17 and then the lower end portion of the heddle 17 is removed by the heddle removing means 62, the heddle positioning member 74 is rotated in the direction L and inserted from the intersection M thereof between the removed heddle 17 and the next heddle 17. As a result, the lower end portion of the removed heddle 17 is guided along the outer inclined face 74*d* and the outer side face 74*b*, and is transferred to the third guide member 79 of the removing means 62. At the same time, the next heddle 17 is guided along the inner inclined face 74*c* and the inner side face 74*a*, and is then moved back to the position of the engaging faces 56*b* and 57*b* which are located when the lower stop fingers 56 and 57 are rotated in the closed positions. Thereafter, the lower stop finger 56 or 57 is rotated in the closed position to limit the movement of the heddle 17.

Figure 17:
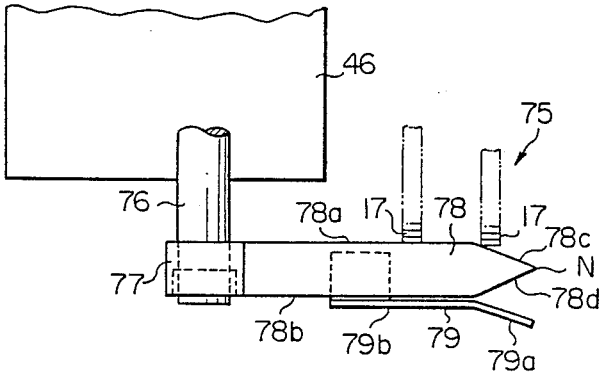
FIG. 17 is a fragmentary side view showing an upper heddle fixing means constructed in accordance with the present invention.
Figure 18:
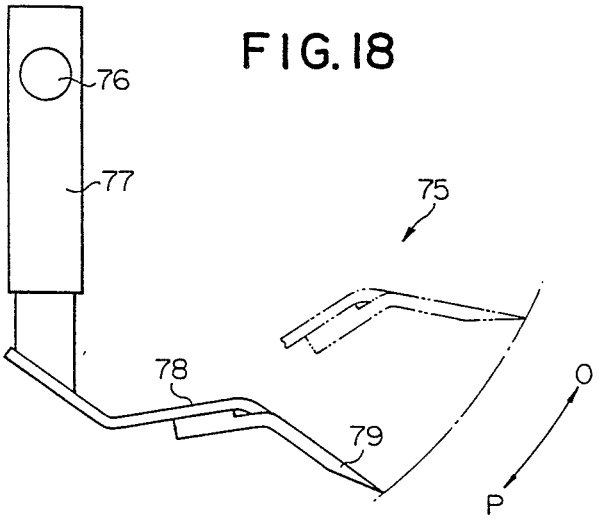
FIG. 18 is a front view of the upper heddle fixing means shown in FIG. 17.
Figure 19:
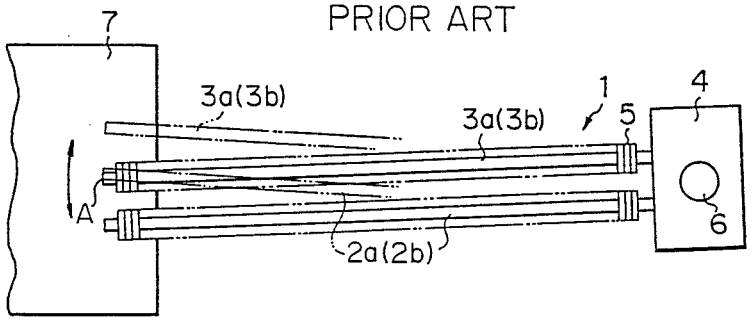
FIG. 19 PRIOR ART
FIG. 19 is a top plan view showing a conventional heddle magazine.
Figure 20:
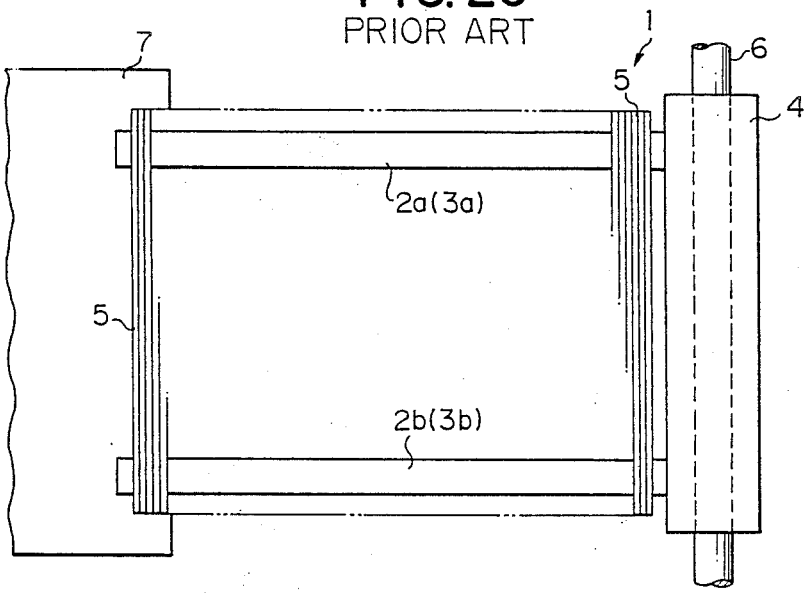
FIG. 20 PRIOR ART
FIG. 20 is a side elevational view of the conventional heddle magazine shown in FIG. 19.

The upper heddle positioning means 75, as shown in FIGS. 17 and 18, comprises a drive shaft 76 freely rotatably supported on the upper casing 46, an arm 77 fixedly mounted on the drive shaft 76, a first guide member 78 extending radially outward from the arm 77, and a second guide member 79 disposed in parallel relationship to the first guide member 78. The first guide member 78 has an inner side face 78*a*, an inner inclined face 78*c* extending from the inner side face 78*a*, an outer side face 78*b* disposed at the opposite side of the inner side face 78*a*, and an outer inclined face 78*d* extending from the outer side face 78*b*. The inner and outer inclined faces 78*c* and 78*d* forms a pointed end N shown in FIG. 17. The second guide member 79 is spaced a predetermined distance from the outer side face 78*b* of the first guide member 78 and has a guide portion 79*b* extending parallel to the outer side face 78*b* and terminating in the position corresponding the intersection of the outer side face 78b and the outer inclined face 78d. The second guide member 79 further has an inclined portion 79a extending outward from the guide portion 79b. The first guide member 78 is arranged such that the inner side face 78a is on the same vertical plane on which the engaging faces 50a and 51a are located when the upper stop fingers 50 and 51 are rotated toward each other in the closed positions and on which the engaging faces 56b and 57b are located when the lower stop fingers 56 and 57 are rotated toward each other in the closed positions. The drive shaft 76 is connected within the upper casing 46 to suitable drive means (not shown) so that the first and second guide members 78 and 79 can be rotated upward and downward or in directions O and P shown in FIG. 18. When the first and second guide members 78 and 79 are rotated in the direction 0, the inner side face 78a of the first guide member 78 is brought into engagement with the upper end portion of the heddle 17 which is limited to move leftward by the upper stop fingers 50 and 51 which are rotated in closed positions as shown in FIG. 9. Thereafter, when one of the upper stop finger 50 or 51 is rotated in the open position, the first guide member 78 is rotated in the opposite direction P. When the pointed end N of the first guide member 78 is positioned between the upper end portions of the foremost heddle 17 and the next heddle 17, the first guide member 78 is rotated again in the direction O until the inner and outer inclined faces 78c and 78d are inserted between the upper end portions of the foremost heddle 17 and the next heddle 17. As a result, the upper end portion of the foremost heddle 17 is guided along the outer inclined face 78d, inserted between the space between the outer side face 78b and the second guide member 79, and properly positioned. When this occurring, the upper end portion of the next heddle 17 is guided along the inner inclined face 78c, and is brought into engagement with the inner side face 78a. With the engagement of the upper end portion of the heddle 17 with the inner side face 78a, the upper stop fingers 50 or 51 of the upper stop means 48 is rotated again in the closed position, and therefore the leftward movement of the heddle 17 is limited and the upper end portion of the removed heddle 17 is held and fixed by the second hook portion 50c or 51c.

In the heddle thus removed and positioned on the line X—X shown in FIG. 4, a warp thread is drawn through the eye 18 of the heddle 16 by a warp-drawing apparatus (not shown). Thereafter, the upper stop means 48 opens, the heddle removing means 62 and the lower heddle positioning means 70 rotate, and the heddle 17 is released. The released heddle 17 is transferred to a predetermined position by suitable transferring means. It is noted that the space between the outer side face 78b of the first guide member 78 of the upper heddle positioning means 75, and the third guide member 79, is set a predetermined value which allows the upper end portion of the heddle 17 to be smoothly guided and to be properly supported. It is also noted that the movement of the drive shafts 38, 39, 40 and 41, the opening and closing of the upper and lower stop means 48 and 49, and the rotation of the heddle removing means 62, lower heddle positioning means 70 and upper heddle positioning means 75, are executed according to a predetermined program by an microcomputer which controls the respective actuators or drive means which are connected with the aforesaid drive shafts and means.

The operation of the apparatus thus constructed in accordance with the present invention will hereinafter be described in detail.

In FIGS. 4 to 7, a plurality of the heddles 17 are inserted on the magazine bars 12a, 12b and 13a, 13b and then the stationary magazine support 16 is held and fixed, between the bracket 32 and lever 30 of the stationary frame member 29 of the warp-drawing apparatus, by the handle 35. As a result, the first heddle group 21 carried on the magazine bars 12a, 12b and the second heddle group 22 carried on the magazine bars 13a, 13b are stationarily supported with respect to the stationary frame member 29 of the warp-drawing apparatus. With the upper and lower stop means 48 and 49 each rotated in their closed positions, and the press members 42, 43, 44 and 45 are advanced in the left direction in FIG. 4 by the respective actuators. Then, the upper end portions of the foremost heddles 17 and 17 of the first and second heddle groups 21 and 22 are respectively brought into engagement with the engaging faces 50a and 51a of the upper stop means 48, and also the lower end portions of the foremost heddles 17 and 17 of the first and second heddle groups 21 and 22 are respectively brought into engagement with the engaging faces 56b and 57b of the lower stop means 49. With this condition, the press members 42, 43, 44 and 45 are brought into a stop. Thereafter, in accordance with previously set programs, drive mechanisms (not shown) controlled by a microcomputer are driven, and one of the upper stop fingers 50 and 51 of the upper stop means 48 and one of the lower stop fingers 56 and 57 of the lower stop means 49 are rotated to selectively remove the foremost heddle 17 of the first or second heddle group 21 or 22. In this embodiment, in order to avoid the complexity of explanation, the explanation will hereinafter be made regarding the case that the upper stop finger 51 of the upper stop means 48 and the lower stop finger 57 of the lower stop means 49 are rotated and that the foremost heddle 17 of the second heddle group 22 is removed and In the operation of members and mechanism, which be described, the drive means for driving the respective members and mechanism are controlled and executed by the aforesaid microcomputer.

After the upper and lower stop 51 and 56 are rotated away from the foremost heddle 17 of second heddle group 22, the first guide member 78 of the heddle positioning means 75 is advanced to the position shown in broken lines in FIG. 5. The press members and 45 are advanced again leftward in FIG. 4 until the end portion of the foremost heddle 17 of the second group 22 is brought into engagement with the inner side 78a of the first guide member 78 of the upper heddle positioning means 75 and until the lower end portion of the foremost heddle 17 of the second heddle group 22 is brought into with the inner side face 67a of the first member 67 of the heddle removing means 62.

The heddle removing means 62 is then rotated in the direction J in FIG. 12. Accordingly, the faces 68b of the second guide member 68 is inserted between the lower end portions of the foremost heddle 17 and next heddle 17 of the second heddle group 22. The lower end portion of the foremost heddle 17 is therefore separated from lower end portion of the next heddle 17, and is inserted between the space between the guide face 67c of the guide member 67 and the guide face 68d of the second guide 68. Thereafter, the lower heddle positioning 70 is rotated until the heddle positioning member 74 is advanced to the position shown in broken lines in FIG. 5, and therefore the pointed end M (FIG. 16) of the heddle positioning member 74 is inserted between the foremost heddle 17 and the next heddle 17. The lower end portion of the foremost heddle 17 separated by the removing means 62 is then transferred through the guide faces 74*d* and 74*b* of the lower heddle positioning means 70 toward the third guided member 79 of the removing means 62, and is positioned between the second and third guide members 68 and 69 of the heddle removing means 62. Also, the lower end portion of the next heddle 17 is moved through the guide faces 74*c* and 74*a* of the lower heddle positioning means 70 back to the position of the engaging face 57*b* which is in the closed position. At the same time, the upper heddle positioning means 75 is rotated again in the direction P in FIG. 18, and therefore the first guide member 78 thereof is moved downward from the position shown in the broken lines in FIG. 5. Concurrently when the pointed end N of the first guide member 78 reaches between the upper end portions of the foremost and next heddles 17 and 17, the upper heddle positioning means 75 is rotated again in the direction O in FIG. 18 and the pointed end N of the first guide member 78 is inserted between these heddles. As a result, the upper end portion of the foremost heddle 17 is inserted and positioned between the side face 78*b* of the first guide member 78 and the second guide member 79. Also, the upper end portion of the next heddle 17 is moved through the guide faces 78*c* and 78*a* of the upper heddle positioning means 75 back to the position of the engaging face 51*a* which is located in the closed position. The upper and lower stop fingers 51 and 57 are rotated in the closed positions, and accordingly the engaging faces 51*a* and 57*b* are brought into engagement with the upper and lower end portions of the new foremost heddle 17, respectively. It is noted that the press members 43 and 45 are moved or stopped according to the movement of the heddle 17 above described. The heddle 17 thus removed is positioned in the predetermined position shown in the line X—X in FIG. 4. In the heddle 17 thus positioned, a warp thread is drawn through the heddle eye 18 by a warp-drawing apparatus. The heddle with the warp thread passed therethrough is transferred to a predetermined position by suitable transferring means (not shown).

As previously indicated, in the present invention, two rows of the first magazine bars 12*a*, 12*b* having the first heddle group 21 carried thereon and the second magazine bars 13*a*, 13*b* having the second heddle group 22 carried thereon are fixed through brackets 14 and 15 to the stationary magazine support 16 of the heddle magazine 11. The stationary magazine support 16 of the heddle magazine 11 is held and fixed between the bracket 32 of the stationary frame member 29 and the lever 30 by the handle 35. Thus, the first and second magazine bars 12*a*, 12*b*, 13*a* and 13*b* are stationarily mounted on the stationary frame member 29. In addition, the heddle 17 is removed and positioned one by one selectively from the first and second heddle groups 21 and 22, and immediately after the heddle is positioned, a warp thread can be drawn through the heddle eye.

From the foregoing description, it will be seen that in accordance with the present invention, there is provided an improved heddle magazine which is structurally simple, inexpensive and eliminates the vibration and noise during the operation and wherein the warp-drawing apparatus associated with the heddle magazine can be operated with high speed.

While certain representative embodiments and details have been shown for the purpose of illustrating the invention, it will be apparent to those skilled in this art that various changes and modifications may be made therein without departing from the spirit or scope of the invention.

What we claim is:

1. A heddle magazine comprising:

a pair of first upper and lower magazine bars having carried thereon a plurality of heddles which form a first heddle group;

a pair of second upper and lower magazine bars disposed in parallel relationship to the first magazine bars and having carried thereon a plurality of heddles which form a second heddle group;

a stationary magazine support having said first and second magazine bars stationarily mounted thereon;

advancing means for advancing said first and second heddle groups;

stop means for limiting the movements of said first and second heddle groups which are advanced by said advancing means;

removing means for selectively removing one by one the heddle which is released by said stop means; and positioning means for positioning the removed heddle into a predetermined position.

2. A heddle magazine as set forth in claim 1, wherein said stationary magazine support is fixedly mounted on a stationary frame member of a warp-drawing apparatus.

3. A heddle magazine as set forth in claim 1, wherein said advancing means comprises a pair of first advancing means for advancing said first heddle group and second advancing means for advancing said second heddle group.

4. A heddle magazine as set forth in claim 3, wherein said first advancing means comprises an upper movable shaft and an upper press member mounted on said upper shaft and engageable with the upper end portion of the rearmost heddle of said first heddle group, and a lower movable shaft and a lower press member mounted on said lower shaft and engageable with the lower end portion of the rearmost of said first heddle group, and wherein said second advancing means comprises an upper movable shaft and an upper press member mounted on said upper shaft and engageable with the upper end portion of the rearmost heddle of said second heddle group, and a lower movable shaft and a lower press member mounted on said lower shaft and engageable with the lower end portion of the rearmost heddle of said second heddle group.

5. A heddle magazine as set forth in claim 1, wherein said stop means comprises upper stop means for limiting the movements of the upper end portions of the foremost heddles of said first and second heddle groups, and lower stop means for limiting the movements of the lower end portions of the foremost heddles of said first and second heddle groups.

6. A heddle magazine as set forth in claim 5 wherein said upper stop means comprises a pair of first stop members rotatable toward and away from the upper end portion of the foremost heddle of said first heddle group and having an engaging face engageable with the upper end portion of the foremost heddle of said first heddle group, and a second stop members rotatable toward and away from the upper end portion of the foremost heddle of said second heddle group and having an engaging face engageable with the upper end portion of the foremost heddle of the second heddle group, and wherein said lower stop means comprises a pair of a first stop member rotatable toward and away from the lower end portion of the foremost heddle of said first heddle group and having an engaging face engageable with the lower end portion of the foremost heddle of said first heddle group, and a pair of second stop member rotatable toward and away from the lower end portion of the foremost heddle of said a pair of second heddle group and having an engaging face engageable with the lower end portion of the foremost heddle of the second heddle group.

7. A heddle magazine as set forth in claim 1, wherein said removing means is rotatable in directions substantially perpendicular to the moving direction of the heddle, and comprises a drive shaft having mounted thereon radially extending first and second arms which are spaced from each other, a first rotatable guide member mounted on said first arm and having a first guide face, and a second rotatable guide member mounted on the said second arm and having a second guide face disposed in parallel relationship to said first guide face, the heddle being guided and removed along said first and second guide faces when said removing means is rotated.

8. A heddle magazine as set forth in claim 1, wherein said positioning means is rotatable in directions substantially perpendicular to the moving direction of the heddle, and comprises an upper positioning means for positioning the upper end portion of said removed heddle into said predetermined position, and a lower positioning means for positioning the lower end portion of said removed heddle into said predetermined position.

9. A heddle magazine as set forth in claim 8 wherein said upper positioning means has an outer guide face for guiding the upper end portion of the removed heddle to said predetermined position and an inner guide face for guiding the upper end portion of a new foremost heddle to said stop means, and wherein said lower positioning means has an outer guide face for guiding the lower end portion of the removed heddle to said predetermined position and an inner guide face for guiding the lower end portion of a new foremost heddle to said stop means.

* * * * *